US005676712A

United States Patent [19]

Anderson

[11] Patent Number: 5,676,712

[45] Date of Patent: Oct. 14, 1997

[54] FLASHBACK PROTECTION APPARATUS AND METHOD FOR SUPPRESSING DEFLAGRATION IN COMBUSTION-SUSCEPTIBLE GAS FLOWS

[75] Inventor: Lawrence B. Anderson, Encinitas, Calif.

[73] Assignee: ATMI Ecosys Corporation, Danbury, Conn.

[21] Appl. No.: 441,774

[22] Filed: May 16, 1995

[51] Int. Cl.[6] ..... F17D 3/00

[52] U.S. Cl. ..... 48/192; 169/37; 169/45; 169/48; 169/54; 169/148; 169/161; 122/395

[58] Field of Search ..... 48/192; 169/45, 169/60, 8, 9, 12, 16, 17, 20, 28, 48, 54, 61, 70, 37; 431/33, 346; 122/395

[56] References Cited

U.S. PATENT DOCUMENTS

| | | | |
|---|---|---|---|
| 4,154,141 | 5/1979 | Sayles | 86/1 R |
| 4,374,649 | 2/1983 | Rao | 48/192 |
| 4,975,098 | 12/1990 | Lee et al. | 48/192 |
| 5,154,237 | 10/1992 | Cooper | 169/54 |
| 5,425,886 | 6/1995 | Smith | 252/5 |
| 5,494,004 | 2/1996 | Hunter, Jr. | 122/395 |
| 5,495,893 | 3/1996 | Roberts et al. | 169/37 |

OTHER PUBLICATIONS

"Fenwal Test Detonation Arresting System at NMERI Site," May, 1992 test of Fenwal Detonation Arresting System at New Mexico Engineering Research Institute.

*Primary Examiner*—Christopher Kim

*Attorney, Agent, or Firm*—Steven J. Hultquist; Janet R. Elliott

[57] ABSTRACT

A flashback protection apparatus and method for suppressing deflagration of a deflagration-susceptible gas in a flow system in which the deflagration-susceptible gas is flowed. The method of the invention comprises monitoring the combustible gas to detect deflagration therein, and upon detection of a deflagration event producing a propagating flame front, opposedly directing at the propagating flame front a pressurized non-flammable gas in a sufficient volume and at a sufficient velocity to provide a non-flammable gas flow having a momentum at least opposedly equal to momentum of the propagating flame front and the associated accelerated combustible gas undergoing deflagration.

17 Claims, 3 Drawing Sheets

FLASHBACK PROTECTION APPARATUS AND METHOD FOR SUPPRESSING DEFLAGRATION IN COMBUSTION-SUSCEPTIBLE GAS FLOWS

BACKGROUND OF THE INVENTION

1. Field of the Invention

This invention relates to a flashback protection apparatus for suppressing deflagration in a system including a flow passage through which deflagration-susceptible gas is flowed, and to a method of suppressing deflagration in a gas stream of a combustible character.

2. Description of the Related Art

Combustion systems are utilized in many industrial process systems for such applications as generation of heat, combustion disposal of off-gas, and operations such as welding, brazing, volatilization of materials such as reactants and reagents, etc.

In such systems, a fuel gas, which may be of a single component or multi-component character, is mixed with an oxidant such as high purity oxygen or other oxygen-containing gas, e.g., air or nitrous oxide, and the resulting fuel-oxidant gas mixture is ignited at a combustion locus. The combustion locus may for example be a jet nozzle in the case of welding and brazing equipment, a burner in the case of a boiler heater, an electrical resistance heater disposed at the effluent end of a vent gas stack in the case of combustion treatment of combustible effluent gases, etc.

In semiconductor manufacturing operations, various processing operations can produce various premixed combustible gas streams. Hydrogen and a variety of hydride gases (e.g., silane, germane, phosphine, arsine, etc.) may be present and, if combined with air, oxygen, or other oxidant species, such as nitrous oxide, chlorine, fluorine, etc., form such combustible multicomponent gas mixtures. Many of such gas streams are subjected to scrubbing treatment in the semiconductor manufacturing facility, and scrubbers for soluble gas components carried in hydrogen and other gases are in common use. If for example an air leak in the process piping, joints, etc. occurs, or a cracked scrubber vessel allows air ingress, and air is passed to the hydrogen-filled scrubber in such a facility, then there is a corresponding danger of explosion of the scrubber, due to the accumulated volume of the hydrogen/oxygen combustible mixture at such location of the process system.

Particularly when a gas of a highly volatile and flammable character such as hydrogen is used as a significant component of the mixture, there is the risk and danger of ignition and of uncontrolled combustion of the fuel-oxidant mixture, with resulting propagation of a "flame front" through the gas flow channel of the system toward the accumulated source of premixed fuel and oxidizer, termed "flashback." The ultimate risk of flashback is a catastrophic or otherwise detrimental explosion at such a source, which may for example comprise a tank or other vessel holding the fuel/oxidant mixture.

In this respect, it is to be noted that mere burning or deflagration of a fuel/oxidant mixture proceeds at a much slower speed than detonation of a combustible fuel/oxidant mixture. Detonation proceeds along a shock wave having a speed in excess of Mach 1. Accordingly, if the deflagration phenomenon proceeds through the transition to detonation, the allowable response time "window" for taking remedial action becomes vanishingly small.

A system having as its goal the supression of the risk of detonation therefore must be capable of rapid response to the deflagration event, and must effectuate the remedial action prior to the onset of detonation.

Although the art has utilized thermocouples to sense the occurrence of deflagration in process systems, commercially available thermocouples, by virtue of their operation based on a sensed temperature differential, are inherently slow and unable to respond in a very rapid manner to the initiation of deflagration in such systems. Pressure sensors have also been employed, but pressure sensors respond only after the deflagration is well developed and may already be near to the transition to detonation.

Accordingly, there exists in the art an established and continuing need for improved apparatus and method to suppress deflagration of deflagration-susceptible gas, in systems in which combustible gas mixtures are flowed through or accumulate in the system or a portion thereof.

It therefore is an object of the present invention to provide a flashback suppression apparatus and method for suppressing deflagration in a flow system in which deflagration-susceptible gas is flowed, e.g., from a fuel source to a combustion site, or accumulated, e.g., in the hydrogen scrubber of a semiconductor processing facility.

It is another object of present invention to provide such a flashback protection system of a relatively simple, economic, and easily operated character.

Other objects and advantages of the present invention will be more fully apparent from the ensuing disclosure and appended claims.

SUMMARY OF THE INVENTION

The present invention broadly relates to flashback protection apparatus and a method for suppressing deflagration of a deflagration-susceptible gas in a flow system, e.g., a flow system in which the deflagration-susceptible gas is flowed from a source to a combustion site, or a flow system in which oxidant and fuel components are present in concentrations susceptible to deflagration and detonation.

In a specific apparatus aspect, the present invention relates to a flashback protection apparatus for suppressing deflagration in a system which includes a flow passage with an inlet end and an outlet end defining a gas flow path therethrough, from the inlet end to the outlet end. Such apparatus comprises:

a source of pressurized non-flammable gas joined in latent gas flow communication with the gas flow path;

a flow controller operatively arranged for selectively establishing gas flow communication between the source of pressurized nonflammable gas and the gas flow path;

an optical sensor assembly constructed and arranged to detect deflagration in the flow passage during flow of combustible gas therethrough, and to (i) maintain a non-flow condition of the pressurized non-flammable gas to the gas flow path during non-deflagrating gas flow of combustible gas through the gas flow path, and (ii) responsively actuate the flow controller to selectively establish the gas flow communication between the source of pressurized non-flammable gas and the gas flow path upon detection of deflagration in the gas flow passage during gas flow of combustible gas therethrough;

wherein the apparatus is constructed and arranged so that the pressure and volumetric flow rate of the pressurized non-flammable gas, flowed from the source thereof to the gas flow path, upon detection of deflagration in the gas flow passage during flow of combustible gas therethrough, provides a pressurized non-flammable gas momentum at least opposedly equal to momentum of combustible gas undergoing deflagration in the gas flow passage.

In specific aspects of the apparatus broadly described hereinabove, the gas flow communication may be effected by a conduit, flow channel, or other gas flow conveyance means, for passing the pressurized non-flammable gas from the source thereof to the gas flow passage.

The flow controller may for example include a valve which is selectively openable and closable. Such valve typically is held in the closed position not allowing gas flow from the pressurized non-combustible gas source to the gas flow passage. The valve is selectively openable to initiate sudden and substantial bulk flow of the pressurized non-flammable gas from the source thereof to the gas flow passage, via valve controller means joined in signal communication relationship with the optical sensing assembly. Such communication may be established by mans of electrical signal transmission wires, wireless signal transmission circuitry, optical waveguides (fiberoptic cable), etc.

The optical sensor assembly which is constructed and arranged to detect deflagration in the flow passage, during the flow of combustible gas therethrough, may suitably comprise a photodiode and operational amplifier circuitry, for detecting the light accompanying deflagration of the combustible gas, and generating an amplified electrical signal to the flow control means described above.

Alternatively, other optical sensing means, comprising a fast light meter (luminometer), photon counter, or other electromagnetic detection means sensitive to the radiation flux, intensity or other optical parameter of the deflagration event, may advantageously be employed in the apparatus of the present invention.

In a method aspect, the present invention broadly relates to a method of suppressing deflagration of a combustible gas susceptible thereto, comprising the steps of:

monitoring the combustible gas to detect deflagration therein; and upon detection of a deflagration event producing a propagating flame front, opposedly directing at the propagating flame front a pressurized non-flammable gas in a sufficient volume and at a sufficient velocity to provide a non-flammable gas flow having a momentum at least opposedly equal to the effective momentum associated with the propagating flame front in the combustible gas undergoing deflagration.

The foregoing method, of suppressing deflagration of a combustible gas susceptible thereto, may be advantageously carried out in a flashback protection system comprising the apparatus according to the present invention, as broadly described hereinabove.

Other aspects and features of the present invention will be more fully apparent from the ensuing disclosure and appended claims.

DETAILED DESCRIPTION OF THE INVENTION, AND PREFERRED EMBODIMENTS THEREOF

Figure 1:
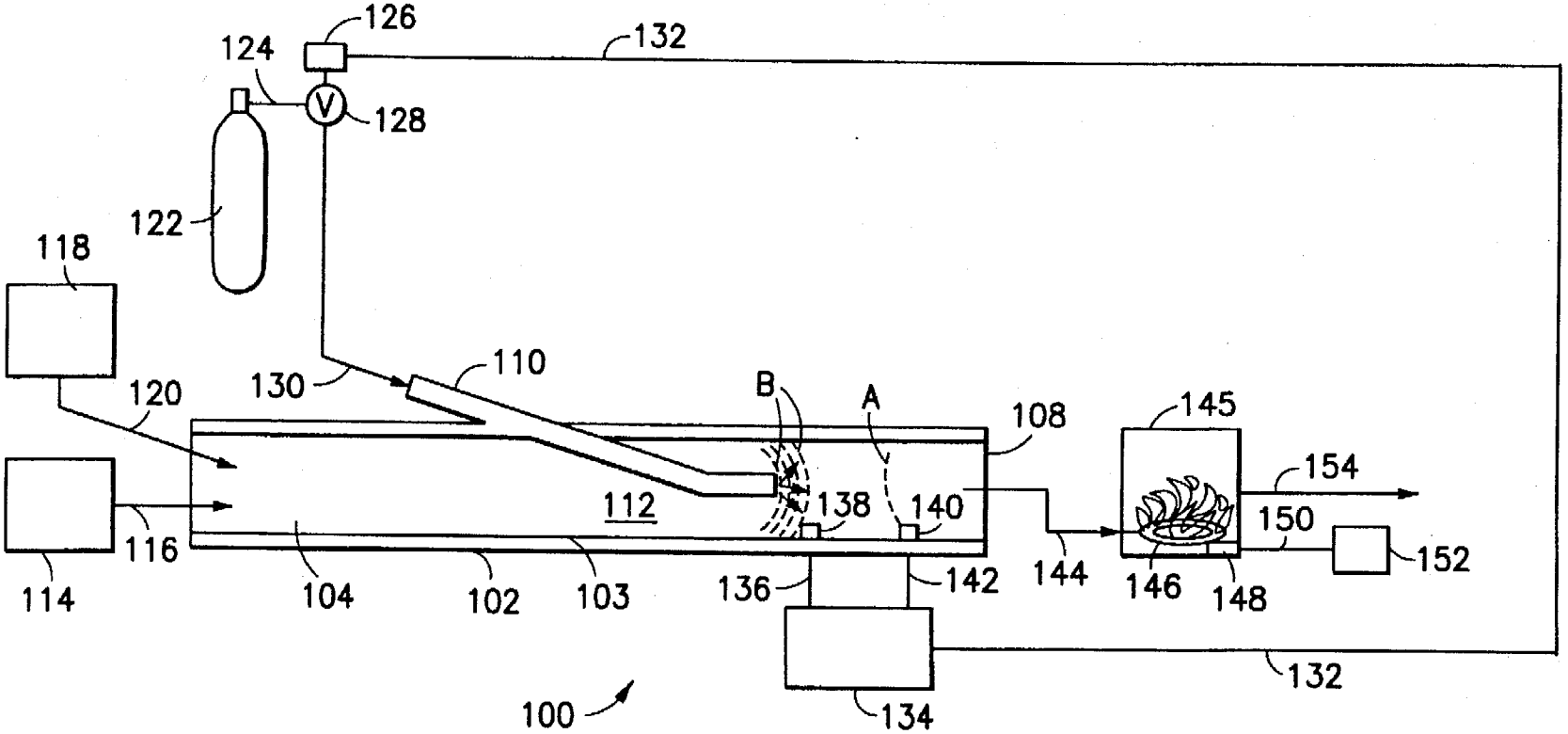
FIG. 1 is a schematic representation of a flowsheet of a flashback protection system according to one embodiment of the present invention.

The present invention broadly relates to a flashback protection apparatus and method for suppressing deflagration of a deflagration-susceptible gas in a flow system in which the deflagration-susceptible gas is flowed from a source to any potential ignition site. The source of the deflagration-susceptible (i.e., combustible) gas may be suitably coupled to flow passage means, such as a tube, channel, conduit, or the like, in which the combustible gas is flowed. The flow passage may contain fuel, or a premixed fuel/oxidant mixture. The fuel may for example be passed in the gas flow passage to a scrubber or other gas treatment sub-system, or the fuel may be mixed with oxygen or other oxidant, to produce a combustible gas mixture for ignition and burning thereof at a desired ignition locus.

The invention is based on the surprising and unexpected finding that the "flashback" phenomenon occurring when a combustible fuel/oxidant mixture is undesirably ignited in a flow passage, due to air leakage, spark generation, flow anomalies, and/or other hydrodynamic or compositional effects, can be efficiently suppressed, without the occurrence of potentially catastrophic flame propagation to the accumulated fuel/oxidizer source, by opposedly impacting the flame propagation front with an amount of a non-combustible gas having a momentum at least equal to the momentum of the combusting gas mixture of fuel and oxidant which is generating the flame propagation front.

In such manner, the "bolus" or bulk volume of the moving non-combustible gas acts to physically and kinetically "stop" the advance of the flame propagation front in the environs in which the fuel/oxidant mixture is combusting.

In contrast to this impulse momentum approach to suppressing the propagation of the flame front of the combusting gas, the prior art, in instances where a gas susceptible to explosive ignition is being flowed from a source vessel to a downstream further processing point, has approached the explosion hazard problem by attempts to dilute the gas near the point of premature combustion.

Such approach, however, is generally inadequate to reduce the concentration of the combustible component of the gas to below the lower explosive limit (LEL) within a suitably short period of time, given that the propagation rate of the flame front of highly flammable gases such as hydrogen/air mixtures may be very high, e.g., on the order of 3 meters per second. With such extremely high rates of advance of the flame front in the combusting gas, the dilution effect requires a significant finite time to effect, even with highly turbent flows of the dilution gas otherwise favorable to mixing and dilution of the contacted fuel/oxidant mixture. Additionally, if the deflagration front is sensed by thermocouple or pressure sensing means, then the response time can be slow, and the deflagration event can progress to detonation before remedial action is taken to prevent explosion in the process system.

Further, relative to the impulse momentum method of the present invention, the fundamental rationale of the prior art approach of dilution points the skilled artisan away from the methodology of the present invention. This stems from the fact that the high volumetric flow rate, high momentum flows of deflagration-supressing gas utilized in the practice of the present invention are not favorable to mixing and dilution. Contrariwise, such flows would be expected to force a high level of flow separation and stratification in the streams or jets of fluid being directed at one another from opposite directions, with some mixing occurring, but accompanied by significant penetration of unmixed portions of the respective gas streams into the bulk of the opposingly directed gas flow stream.

Accordingly, the prior art practice of dilution of a combusting gas mixture below its LEL of combustible component(s) does not in any way suggest the approach of the present invention, but rather emphasizes the novelty and unobviousness of the method and apparatus of the present invention.

Further, the prior art has not contemplated the impulse momentum flashback supression approach of the present invention, because there has been a failure in the art to recognize the effect on gas velocity (in the combusting gas) of gas expansion affects.

In a spatially restricting passage such as an open pipe carrying the combustible gas mixture, burning is accompanied by an expansion wave propagated away from the burning area or "flame front" in both directions towards the respective ends of the pipe. By way of illustration, suppose that the gas in such a system were ignited at one end of the pipe. As the flame front moves along (inside) the pipe, the heated and expanded gas containing combustion products immediately behind the flame front pushes hot reacted gases toward the initially ignited end of the pipe, and the cold, as yet unreacted combustible gas is pushed toward the opposite end.

Suppose now that the combustible gas were initially flowing in the pipe so that the flame front is able to be described as moving "upstream" in this flow relative to the fixed frame of reference of the pipe. The expansion effects can accelerate the cold unreacted gas ahead of the moving flame front upstream, thereby slowing or even reversing the flow direction. Since the flame front itself is embedded in this moving stream, the speed of this flame front through the pipe can greatly exceed the actual burning speed relative to the unburned gas alone.

The effective momentum which must be imparted in the opposing direction to this "moving front" at any instant (subsonic flow) is the product of the front's velocity relative to the pipe times the mass of the pipe which must be brought to the same opposing velocity in order to stop the motion of the flame front relative to the pipe.

An effective injector satisfying this criterion will also subsequently act as an ejector pump to keep the gas it accelerates moving in the downstream direction at a speed which exceeds the flame front speed. This eliminates the possibility of significant upstream propagation of buring elements based on velocity considerations alone, i.e., without invoking as yet any dilution considerations attributable to the non-combustible gas issuing from the injector.

Against this background, I have determined that in actual deflagration of combustible gas in relatively short, open tube experimental systems, the velocity of the flame front is typically at least on the order of twice the corresponding literature values for maximum flame speeds, for gases as disparate in combustibility characteristics as hydrogen and methane. (The imparted stream velocity therefore needs to be subtracted from the total observed propagation velocity in order to calculate the actual flame speed.) In consequence, the actual transit times for the flame of the combustion front to traverse the flow passage containing the gas flow stream may be significantly shorter than would be expected based solely on the published flame speeds alone.

In the case of strong, e.g., loud, deflagrations, such as hydrogen/air deflagrations, the imparted stream velocity effect dominates and the actual observed, uncorrected flame speeds can be an order of magnitude higher than the published maximum value. In such deflagrations, there is a definite pressure rise inside the gas flow passage, and a blast pulse is observed, as accompanying the audible report of the deflagration.

The present invention takes cognizance of the foregoing, and utilizes injection of an opposingly directed (relative to the direction of propagation of the flame front) non-combustible gas. Such non-combustible flashback-supressing gas may be a single component gas species or a gas mixture, in an amount and at a sufficient volumetric flow rate and velocity to provide injected gas momentum that matches or exceeds the momentum of the combusting gas.

The injection of the non-combustible gas may be effected in the How passage in which the combustible gas is flowed, by means of an on-axis injector to introduce the non-combustible gas, in the gas flow passage, at a sufficient velocity opposing the accelerated stream, to effectively "butt heads" with the approaching unreacted combustible gas which carries behind it the approaching flame front.

Advantageously, the point of injection and the amount of the non-combustible gas is selected so that there is adequate development of the injected gas "front" into plug flow when intercepting the combusting gas. The injected gas front of non-combustible gas thus overcomes the combustible gas front, and sweeps the combustible gas back downstream. Such injection may or may not also reduce combustible gas concentrations below their flammability limits.

The non-combustible gas utilized to suppress the combustion of the combustible gas in the gas flow passage may be of any suitable species which is inert or otherwise non-combustible in character. Examples of potentially useful non-combustible gas species include nitrogen, argon, xenon, and krypton, and mixtures thereof.

The present invention therefore contemplates a flashback protection apparatus for suppressing deflagration in a combustible gas flow system including a combustible gas flow passage with inlet and outlet ends defining a gas flow path therethrough from the inlet (upstream) end to the outlet (downstream) end of the passage. As used herein, the term "flow passage" in reference to the combustible gas is intended to be broadly construed to encompass pipes, conduits, hoses, tubes, channels, ducts, and all other flow path-defining structures by and/or in which the combustible gas is made to flow in a continuous, bulk, and/or batch manner.

The source of injection gas (pressurized non-combustible gas) joined in latent gas flow communication with the gas flow path in the broad practice of the invention may suitably comprise a tank, cylinder, or other storage or supply means and associated piping, conduits, etc., by which the non-combustible gas is delivered to the gas flow passage. The source may by way of specific example comprise a high pressure cylinder of nitrogen or other non-combustible gas, joined at a regulator or valve head of the cylinder to a line interconnecting the cylinder with the gas flow passage containing the flowing combustible gas.

The supply arrangement for delivering the non-combustible gas to the combustible gas flow passage may include a flow controller which is operatively arranged for selectively establishing gas flow communication of the source of pressurized non-combustible gas with the gas flow path. The flow controller may for example include a valve which is selectively openable and closable, being normally in the closed position not allowing gas flow from the pressurized non-combustible gas source to the gas flow passage, and selectively openable to initiate sudden and substantial bulk flow of the pressurized (non-combustible) gas from the source thereof to the gas flow passage, via valve controller means. Such valve controller means may be joined in signal communication relationship with the optical sensing assembly, such as by electrical signal transmission wires, wireless signal transmission circuitry, optical waveguide (fiber optic cable), etc.

The optical sensing of the deflagration event in the combustible gas is a critical aspect of the present invention, due to the rapid response of the flashback supression system which thereby is achieved. By contrast, the thermocouple-based flashback sensing systems of the prior art have a very slow response time, and in many instances may not possess the responsivity to arrest deflagration or to prevent the progression of the deflagration to detonation in the process system.

The flow controller in one embodiment of the invention comprises a flow control valve and associated valve actuator disposed in the line interconnecting the non-combustible gas supply with the combustible gas flow passage.

Alternatively, the flow controller may comprise a regulator assembly associated with a high-pressure cylinder of the non-combustible gas, in which the regulator assembly includes a selectively openable and closable flow control element or subassembly, for selectively initiating or terminating the flow of non-combustible gas to the combustible gas flow passage.

An optical sensor assembly is utilized which is constructed and arranged to detect deflagration in the flow passage during gas flow of combustible gas therethrough, and to (i) maintain a non-flow condition of the pressurized non-combustible gas to the gas flow path during non-deflagrating gas flow of combustible gas through the gas flow path, and (ii) responsively actuate the flow controller to selectively establish the gas flow communication of the source of pressurized non-combustible gas with the gas flow path upon detection of deflagration in the gas flow passage during gas flow of combustible gas therethrough.

The optical sensor assembly is constructed and arranged to detect deflagration in the flow passage during flow of combustible gas therethrough, and may suitably comprise one or more photodiode(s) and operational amplifier circuitry for detecting the light flash and generating an amplified electrical signal to the flow control means described above.

Alternatively, other optical sensing means comprising a light meter, photon counter, or other electromagnetic detection means sensitive to the radiation flux, intensity or other optical parameter of the deflagration event, may advantageously be employed in the optical sensor assembly.

Such sensing element in the optical sensor assembly is operatively coupled with control circuitry or other subassembly component(s) which operates to actuate the flow controller to provide contemporaneous, real-time flow of the non-combustible gas to the gas flow passage in response to the sensed deflagration event. The pressurized non-combustible gas flowed to the gas flow passage has a pressure and a volumetric flow rate into the gas flow passage providing a the pressurized non-combustible gas momentum that is at least opposedly equal to, and preferably significantly greater than (e.g., at least 5% higher, more preferably at least 15% higher, and most preferably at least 25% higher than) the momentum developed by the accelerated combustible gas undergoing deflagration at an upstream location in the gas flow passage.

The system of the invention thus operates to suppress deflagration of the combustible gas by (1) monitoring the combustible gas to detect deflagration therein; and (2) upon detection of a deflagration event producing a propagating flame front, opposedly directing at the combustible gas including the propagating flame front, a pressurized non-flammable gas in a sufficient volume and at a sufficient velocity to provide a non-flammable gas flow having a momentum at least opposedly equal to momentum of the propagating flame front and the combustible gas undergoing deflagration.

Referring now to the drawings, FIG. 1 shows a schematic flowsheet of a flashback protection system 100 according to an illustrative embodiment of the present invention.

In such flashback protection system 100, a gas flow passage 102 is provided in the form of a tube 103 whose wall may be formed of any suitable material and thickness. The tube wall of gas flow passage 102 defines therewithin an interior volume constituting a gas flow path 104 from an inlet end 106 to an outlet end 108 of the tube.

At the inlet end portion of tube 103 comprising inlet end 106, a fuel from a fuel source 118 is flowed by means of line 120 into the inlet end portion of the gas flow path 104. Concurrently, an oxidant medium from oxidant source 114 is flowed via line 116 into the inlet end portion of the gas flow path 104. The fuel may comprise any suitable combustible species, such as a hydrocarbonaceous fuel e.g., methane, or other combustible gas such as hydrogen. The oxidant in turn may be of any suitable composition, e.g., air, oxygen, etc.

Although FIG. 1 shows a schematic representation of a system in which an oxidant medium is added to the fuel component from an oxidant 114 to form a fuel/oxidant mixture, it is to be recognized that the fuel/oxidant mixture could be formed by air leakage into a fuel gas-containing stream flowing in the tube 103, from a leak in the process system.

At the outlet end portion of gas flow path comprising outlet end 108 of tube 103, the fuel/oxidant mixture is flowed via combustible gas mixture feed line 144 to burner 146 in furnace 145. The furnace 145 has disposed beneath burner 146 a spark ignition device 148 which is provided with electrical energy by means of wire 150 from electrical power source 152. The spark ignition device 148 is electrically actuated and is selectively operated to generate a spark to ignite the fuel/oxidant mixture on burner 146 in the furnace, thereby producing combusted gases which are discharged from the system in line 154.

At the outlet end portion of the gas flow path 104, within tube 103, is provided one or more photosensors. In the specifically illustrated system, the photosensor means comprise photodiode sensors 138 and 140, which may be deployed behind a heat-resistant, light-transmissive material such as quartz or silica glass, so that the sensors can sense light incident to a deflagration event at such outlet end portion of the gas flow path.

The photodiode sensor 138 is joined by signal transmission wire 136 to the optoelectronic conversion module 134, in which the optical sensing of photodiode sensor 138 is converted to an electronic signal which is passed to signal transmission line 132. In like manner, the photodiode sensor 140 is connected by signal transmission line 142 to the optoelectronic conversion module 134, for conversion of an optical sensing by the sensor 140 to an electrical signal which then is passed to signal transmission wire 139. The signal transmission lines 136 and 142 may for example comprise a light wave guide, such as a suitably dad optical fiber, or other suitable light transmission means, whereby the optoelectronic conversion module 134 is able to receive a signal indicative of the presence of a deflagration event at the outlet end portion of the gas flow path 104.

Upstream (such direction being identified in reference to the outlet end 108 of the gas flow passage tube 103) from the outlet end portion of the tube 103, a non-combustible gas injection conduit 110 passes through the tube wall to an interior discharge open end 112, which is at a central region of the gas flow passage tube. The gas injection conduit may be formed at its interior end in the gas flow passage with a reduced diameter or nozzle structure to provide high-impulse injection of the deflagration-supressing gas.

A source 122 of non-combustible gas is provided, such as a high-pressure gas cylinder, a cryogenic air separation plant (producing nitrogen), or other suitable gas supply means. The non-combustible gas source 122 is joined by feed line 124 to a flow control valve 128, which in turn is operatively coupled with valve controller 126. The valve controller 126 in turn is connected to signal transmission line 132, and is thereby constructed and arranged so that the valve controller 126 is selectively actuatable to open or dose valve 128, in response to the signal transmitted to controller 126 from signal transmission line 132.

Valve 128 is connected to flow line 130, which in turn is joined, as for example by suitable fitting or other coupling means (not shown), to the non-combustible gas injection conduit 110.

In operation of the above-described system shown in FIG. 1, fuel from fuel source 118 is flowed through fuel feed line 120 to the inlet portion of the gas flow passage 102, concurrent with flow of oxidant from oxidant source 114 through line 116 to such inlet portion of the gas flow passage. The resulting fuel/oxygen mixture then is flowed longitudinally through the gas flow passage to the outlet end portion of tube 103, being discharged in combustible gas mixture feed line 144 and passed to burner 146 in furnace 145 for combustion. The combustion in furnace 145 is originally initiated by spark ignition device 148 which is electrically actuated by electrical power source 152 joined to the spark ignition device 148 by means of electrical wire 150. The electrical power source 152 may be joined to computer control or other selectively automated means (not shown) whereby the burner may be turned on and ignition begun in an appropriate manner, relative to the initiation of flow of fuel and oxidant from sources 118 and 114, respectively.

During operation of such combustible gas mixture burning operation, the incidence of any deflagration event will produce a flame front A (indicated in dashed outline form in the interior volume of tube 103) which will be sensed by photodiode 140. Such event therefore will generate an optical sensing signal which is transmitted by signal transmission line 142 to the optoelectronic conversion module 134, containing circuitry of a known conventional type for converting an optic light signal to an electronic signal. The resulting output electronic signal may be digital or analog in character, and is transmitted by means of signal transmission line 132 to the valve controller 126. Prior to such flashback event, valve 128 is maintained in a dosed condition, so that no flow of non-combustible gas from gas source 122 is permitted to flow into gas flow line 130.

Upon detection of the deflagration event, and corresponding actuation, by means of signal transmission wire 132, of valve controller 126, the valve controller 126 operates to open valve 128, resulting in the flow of high-pressure, non-combustible gas from gas source 122 through line 124 and valve 128 to gas flow line 130, and injection conduit line 110. The high-pressure, non-combustible gas then is discharged at distal end 112 of the injection conduit 110, in sufficient volume and velocity to quickly produce a plug flow of the non-combustible gas, indicated by flow profile line B in FIG. 1.

The volumetric flow rate and velocity of such non-combustible gas is sufficient to provide a momentum which is at least equal to the momentum associated with the combusting and approaching flame front A. By such opposed flux of non-combustible gas, the flame front is redirected to the outlet end 108 of the gas flow passage and the combusting (flashback) gases are forced through combustible gas mixture feed line 144 to the burner 146 in furnace 145.

The upstream (relative to photodiode 140) photodiode 138 is provided as a fail-safe mechanism, in the event that there is advance of the flame front A to a position where the deflagration event is sensed by photodiode sensor 138. In such event, the photodiode sensing from sensor 138 is passed by optic signal transmission line 136 to the optoelectronic conversion module 134, and a correlative electronic signal is passed by signal transmission wire 132 to the controller 126, which may for example cause the valve 128 to open to a fully open position, beyond the open position initiated by the signal generated by sensing from photodiode sensor 140, so that the mass flux of non-combustible gas directed through injection conduit 110 into tube 103 is significantly increased, to halt and reverse the direction of travel of the flame front. Alternatively, in such event, the controller 126 may actuate a separate injection of a flashback-supression gas from a farther upstream location, or other flashback supression, or explosion prevention action. It will be recognized that the length of the gas flow passage may be substantial, and that the optional backup photodiode, if provided at all, may be spaced from the main photodiode 140 by a significant distance.

Figure 2:
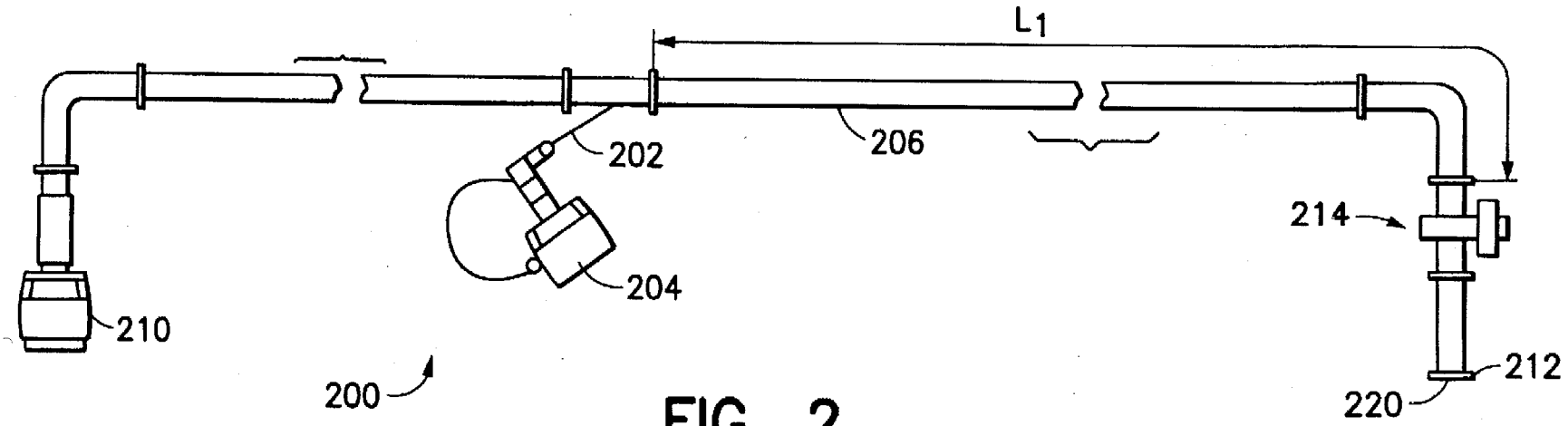
FIG. 2 is schematic representation of a flashback protector system and associated piping, according to another embodiment of the invention.

FIG. 2 is a schematic representation of a flashback protection system 200 and associated piping and components of another embodiment of the present invention. The overall apparatus assembly comprises flashback protection apparatus 200, including non-combustible gas injection line 202 and the injector module 204 featuring a pressure switch which may for example be adjustable from 3 to 300 psi in pressure level, to correspondingly adjust the pressure of the gas injected through non-combustible gas injection line 202. The module 204 also includes a solenoid valve and associated connectors, whereby the module may be interconnected with a source of high-pressure non-combustible gas, such as a cylinder of nitrogen at super-atmospheric pressure. The flashback protection apparatus 200 as shown in this embodiment is associated with a corresponding length of the pipe 206 having a connector 210 at one end thereof and a coupleable fixture 212 at its opposite end, such as a flange which is clampable to a combustion effluent treatment apparatus (not shown). Since in such system, the solenoid valve is the slowing or limiting response element, it is desirable to obtain a solenoid valve which is rapidly actuable for opening thereof, to initiate the flow of flashback suppressing gas to the gas flow passage at a high velocity and volume flow rate.

Upstream of the fixture 212 is disposed an optical sensing assembly 214, including photodiodes, which are interconnected by means of suitable signal transmission means (not shown in FIG. 2) to means for converting the optical sensing of the light detection means in sensing assembly 214 to signals for controlling the flow or non-flow conditions of the injector module 200.

In the system shown in FIG. 2, the distance $L_1$ along the corresponding length of pipe shown in the drawing may be on the order of 2.5 meters in length, comprising a straight run of pipe of at least 1.3 meters in length from the non-combustible gas injection point associated with injector module 200, to allow development of plug flow of the injected non-combustible gas, upstream of the pipe end 220 at which the fixture 212 is joined to the effluent combustion or other processing unit in the overall system.

Figure 3:
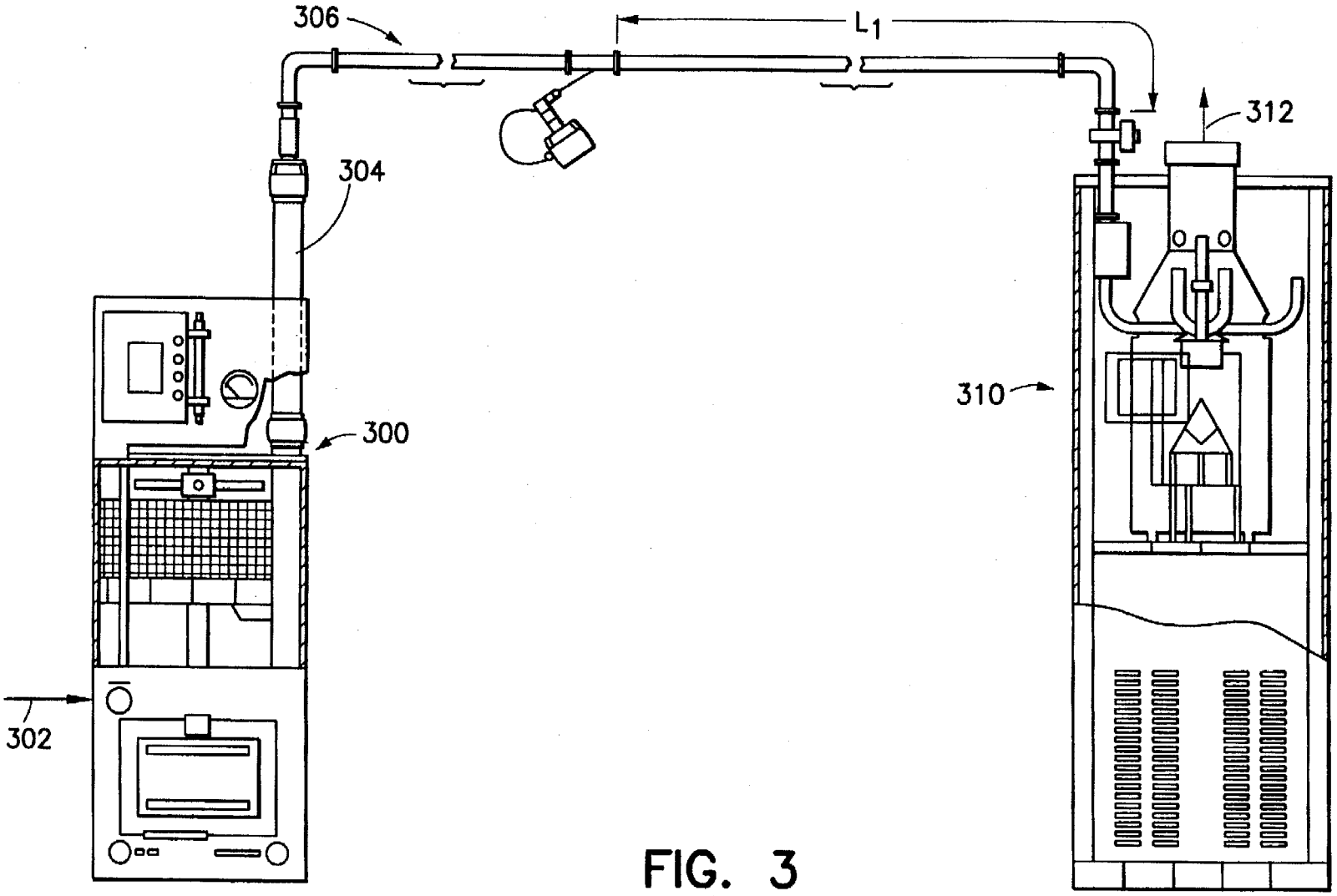
FIG. 3 is a schematic representation of a portion of a semiconductor manufacturing facility process effluent gas treatment system comprising the flashback protector system of FIG. 2.

FIG. 3 is a schematic representation of a portion of a semiconductor manufacturing facility effluent processing apparatus, including a scrubber device 300 which may for example comprise a water scrubber or chemisorbent treatment medium with which effluent gases from the semiconductor manufacturing operation are contacted, to effect removal of gases such as arsine, phosphine, diborane, hydrogen chloride, dichlorosilane, trichlorosilane, tetrachlorosilane, ammonia, boron trichloride, aluminum trifluoride, aluminum trifluoride, hydrogen fluoride, tetraethylorthosilicate, chlorine, fluorine, boron trifluoride, tungsten hexafluoride, and/or hydrogen bromide, among others.

The process effluent from the semiconductor manufacturing facility is flowed to the scrubber 300 by feed line 302 and the resulting scrubbed gas containing combustible component(s) is discharged from scrubber 300 in discharge line 304 and passed to the flashback protection system 306, the elements of which are numbered correspondingly with respect to FIG. 2. The effluent passing through the flashback protection system 306 then flows into the combustor 310, which may for example comprise an active flame oxidizer of the type commercially available from ATMI Ecosys Corporation (San Jose, Calif.) under the trademark Phoenix.

The combustor 310 comprises a chamber that mixes the process effluent with air and fuel from conduit 206, in a turbulent combustion zone. Such mixing results in high destruction rates of the combustible component(s) of the effluent, using natural gas or hydrogen fuels.

The resulting effluent from the combustor 310 is discharged in vent line 312 and may be passed to the ambient atmosphere or otherwise to further disposition and/or processing.

In the effluent treatment assembly shown in FIG. 3, the settings of the flashback suppression gas feed supply associated with the non-combustible gas injection line 200 may be set to provide any appropriate flux of flashback suppression gas to conduit 206, appropriate to the flow rate of the normal gas flow through pipe 206 and the combustibility of the gas in such pipe under flashback conditions.

The specific flux and amount of gas necessary to suppress flashback conditions in a given system may readily be determined by those skilled in the art without undue experimentation, by the simple expedient of simulating process flow and flashback ignition conditions in a gas flow passage simulating the actual operating environment in which flashback suppression is desired, with sequential injection of varying fluxes of gas under flashback conditions. In such determination, the effects of the expansion of gas incident to combustion and the acceleration of the flame front beyond values tabulated in the literature should appropriately be taken into account, to insure the appropriate operation of the flashback protection system.

The features and operation of the present invention are more fully illustrated by the following non-limiting example.

EXAMPLE

A gas combustion system according to the present invention was constructed and operated to effect the combustion of a mixture of hydrogen and air.

The hydrogen and air were injected for intermixing into a 3.8 centimeter diameter stainless steel tube, having a nitrogen injector conduit 1 centimeter in diameter entering the tube at a slight sloping angle and bending near its tip to align along the central axis of the tube. A nitrogen solenoid valve was fitted to the end of the 1 centimeter conduit outside the tube wall. A photodiode sensor was provided near the tube wall at the exit end portion, in spaced relationship to the end extremity of the tube.

The nitrogen pressure of a nitrogen supply cylinder was set by adjustment of the regulator head controls to $7.67\times10^5$ Newton/meter$^2$ (100 psig) and a large diameter feed hose was used to supply the solenoid valve with an unrestricted flow of the nitrogen gas. A 2.5 meter overall length of 3.8 centimeter diameter tubing gave excellent results. Care was taken to clear residual nitrogen from the 3.8 centimeter diameter tube after each run. The flows of hydrogen in the majority of the test runs were 0.033 standard liters hydrogen per second into the 3.8 centimeter diameter tube for 20 seconds before triggering spark ignition at the opposite (exit) end of the flow passage tube.

A series of ignition flash-back tests was carried out. The transit time of the flame front was about 90 milliseconds, and the main peak of the flame front passing the photodiode view port was about 10 milliseconds wide at half height. When quartz and glass windows were alternatively used in front of the photodiodes, similar light intensity results were obtained. The nitrogen injector in all instances pushed all of the burning gas out of the ignited (exit) end of the tube, and 1 meter long flashes often erupted there when the nitrogen injector tube solenoid opened, while no flame was observed issuing from the hydrogen inlet end of the 3.8 centimeter diameter tube, in any of the test runs.

While the invention has been illustratively described herein with reference to various exemplary aspects, features and embodiments, it will be appreciated that the utility of the invention is not thus limited, but rather embraces numerous other variations, modifications and other embodiments, and all such other variations, modifications and other embodiments therefore are to be regarded as being within the spirit and scope of the invention as claimed.

What is claimed is:

1. A flashback protection apparatus for suppressing deflagration in a system including a flow passage having an inlet end and an outlet end defining a gas flow path therethrough, said apparatus comprising:

a source of pressurized non-flammable gas joined in latent gas flow communication with the gas flow path;

a flow controller operatively arranged for selective establishment of gas flow communication of the source of pressurized non-flammable gas with the gas flow path; and an optical sensor assembly constructed and arranged to detect deflagration of combustible gas generating a flame propagation front in the flow passage during gas flow of combustible gas therethrough, and to (i) maintain a non-flow condition of the pressurized non-flammable gas to the gas flow path during non-deflagrating gas flow of combustible gas through the gas flow path, and (ii) responsively actuate the flow controller to selectively establish the gas flow communication of the source of pressurized non-flammable gas with the gas flow path upon detection of deflagration in the gas flow passage during gas flow of combustible gas therethrough;

wherein the apparatus is constructed and arranged so that the pressure and volumetric flow rate of the pressurized non-flammable gas, flowed from the source thereof to the gas flow path upon detection of deflagration in the gas flow passage during flow of combustible gas therethrough, provides a pressurized non-flammable gas momentum at least opposedly equal to the momentum of accelerated combustible gas undergoing deflagration in said gas flow passage;

whereby the pressurized non-flammable gas opposedly impacts the time propagation front to stop advancement of the time propagation front in the gas flow path.

2. A flashback protection apparatus for suppressing deflagration in a flow passage having a combustible gas flowed therethrough, said apparatus comprising:

means for selectively supplying non-combustible gas to the flow passage in a direction opposed to combustible gas flow through said flow passage and in a flux providing momentum at least equal to momentum of the combustible gas flowed through the flow passage;

a sensor for detecting a deflagration event in the flow passage generating a time propagation front in said passage; and a controller assembly operatively coupled with the sensor and operative to actuate the means for selectively supplying non-combustible gas to the flow passage upon detection of a deflagration event in the flow passage by the sensor;

whereby the non-combustible gas opposedly impacts the flame propagation front to stop advancement of the flame propagation front in the flow passage.

3. A flashback protection apparatus according to claim 1, wherein the gas flow communication between the source of pressurized nonflammable gas and the gas flow passage is effected by a conduit joining said source and said gas flow passage, and said flow controller comprises a flow control valve disposed in said conduit, said flow control valve being normally in the closed position not allowing gas flow from the pressurized non-combustible gas source to the gas flow passage, and selectively openable to initiate sudden and substantial bulk flow of the pressurized non-flammable gas from the source thereof to the gas flow passage.

4. A flashback protection apparatus according to claim 3, further comprising a valve controller operatively interconnecting said optical sensing assembly and said flow control valve in controlling relationship of the optical sensing assembly to said flow control valve controller, so that said optical sensing assembly upon detection of deflagration in the gas flow passage during flow of combustible gas therethrough, actuates said flow control valve controller to open said flow control valve to selectively establish said gas flow communication of the source of pressurized non-flammable gas with the gas flow path.

5. A flashback protection apparatus according to claim 1, wherein the optical sensor assembly comprises a photodiode and optoelectronic circuitry, for detecting a change in light intensity incident to occurrence of a deflagration event, and generating a signal to said flow controller to initiate said sudden and substantial bulk flow of the pressurized non-flammable gas from the source thereof to the gas flow passage.

6. A flashback protection apparatus according to claim 1, wherein the pressurized non-flammable gas momentum at least 5% higher than the momentum of combustible gas undergoing deflagration in said gas flow passage.

7. A flashback protection apparatus according to claim 1, wherein the pressurized non-flammable gas momentum at least 15% higher than the momentum of combustible gas undergoing deflagration in said gas flow passage.

8. A flashback protection apparatus according to claim 1, wherein the pressurized non-flammable gas momentum at least 25% higher than the momentum of combustible gas undergoing deflagration in said gas flow passage.

9. A flashback protection apparatus according to claim 1, wherein the locus of said gas flow communication, and the amount of pressurized non-flammable gas flowed to the gas flow path upon detection of deflagration, provide plug flow of the pressurized non-flammable gas at impact with the flame propagation front in the gas flow path, whereby the pressurized nonflammable gas overcomes the flame propagation front and sweeps it toward an end of the gas flow path.

10. A flashback protection apparatus according to claim 1, wherein the pressurized non-flammable gas comprises a gas selected from the group consisting of nitrogen, argon, xenon, krypton, and mixtures thereof.

11. A flashback protection apparatus according to claim 1, wherein the source of pressurized non-flammable gas comprises a gas cylinder containing said pressurized non-flammable gas.

12. A flashback protection apparatus according to claim 1, wherein the gas flow communication between the source of pressurized non-flammable gas and the gas flow passage is effected by a conduit joining said source and said gas flow passage, and extending into the gas flow passage to an open interior end.

13. A flashback protection apparatus according to claim 12, wherein the open interior end defines a nozzle.

14. A flashback protection apparatus according to claim 1, wherein said system comprises a semiconductor manufacturing facility.

15. A flashback protection apparatus according to claim 1, wherein the inlet end of the flow passage is coupled to a gas scrubber unit, and the outlet end of the flow passage is coupled to a combustor unit.

16. A flashback protection apparatus according to claim 15, wherein the combustor unit comprises a time oxidation unit.

17. A flashback protection apparatus according to claim 1, wherein the optical sensor assembly detects deflagration in the flow passage at two points spaced apart from one another along the gas flow path, and said source of pressurized non-flammable gas is joined in latent gas flow communication with the gas flow path at spaced apart locations thereof, with the apparatus being constructed and arranged to flow pressurized non-flammable gas into the flow passage at each of said spaced apart locations upon detection of deflagration at a respective one of said points.

* * * * *

UNITED STATES PATENT AND TRADEMARK OFFICE

CERTIFICATE OF CORRECTION

PATENT NO. : 5,676,712

DATED : October 14, 1997

INVENTOR(S) : Lawrence B. Anderson

It is certified that error appears in the above-indentified patent and that said Letters Patent is hereby corrected as shown below:

| | |
|---|---|
| Column 6, Line 16 | change "How" to -- flow -- |
| Column 9, Line 1 | change "dad" to -- clad -- |
| Column 9, Line 62 | change "dosed" to -- closed -- |
| Column 13, Line 15 | change "time" to -- frame -- |
| Column 13, Line 16 | change "time" to -- frame -- |
| Column 13, Line 26 | change "time" to -- frame -- |
| Column 14, Line 49 | change "time" to -- frame -- |

Signed and Sealed this

Tenth Day of March, 1998

*Attest:*

*Attesting Officer*

Bruce Lehman

BRUCE LEHMAN

*Commissioner of Patents and Trademarks*